US008477971B2

(12) United States Patent
Chan et al.

(10) Patent No.: US 8,477,971 B2
(45) Date of Patent: Jul. 2, 2013

(54) HEARING DEVICE WITH SUPPORTING HOOK RECOGNITION

(75) Inventors: Hoong Yih Chan, Singapore (SG); Phanhow Amy Cheng, Singapore (SG); Leep Foong Chew, Singapore (SG); Cheoung Hong Lee, Singapore (SG); Meng Kiang Lim, Singapore (SG)

(73) Assignee: Siemens Medical Instruments Pte. Ltd., Singapore (SG)

( * ) Notice: Subject to any disclaimer, the term of this patent is extended or adjusted under 35 U.S.C. 154(b) by 409 days.

(21) Appl. No.: 12/702,468

(22) Filed: Feb. 9, 2010

(65) Prior Publication Data

US 2010/0202646 A1 Aug. 12, 2010

(30) Foreign Application Priority Data

Feb. 9, 2009 (DE) ..... 10 2009 008 045

(51) Int. Cl.
*H04R 25/00* (2006.01)

(52) U.S. Cl.
USPC ..... 381/312; 381/330

(58) Field of Classification Search
USPC ..... 381/330, 312
See application file for complete search history.

(56) References Cited

U.S. PATENT DOCUMENTS

| | | | |
|---|---|---|---|
| 5,341,433 A | 8/1994 | Meyer et al. | |
| 5,824,022 A | 10/1998 | Zilberman et al. | |
| 6,594,707 B1 | 7/2003 | Rubinstein et al. | |
| 6,748,094 B1 | 6/2004 | Tziviskos et al. | |
| 7,221,770 B2 | 5/2007 | Fickweiler et al. | |
| 7,245,728 B2 | 7/2007 | Killion et al. | |
| 2005/0169490 A1 | 8/2005 | Killion et al. | |
| 2008/0260193 A1 * | 10/2008 | Westermann et al. | 381/330 |

FOREIGN PATENT DOCUMENTS

| | | |
|---|---|---|
| DE | 103 33 293 A1 | 3/2005 |
| EP | 0548379 A1 | 6/1993 |
| WO | 2007045254 A1 | 4/2007 |

OTHER PUBLICATIONS

European Search Report dated Sep. 29, 2010.

* cited by examiner

*Primary Examiner* — Davetta W. Goins
*Assistant Examiner* — Amir Etesam
(74) *Attorney, Agent, or Firm* — Laurence A. Greenberg; Werner H. Stemer; Ralph E. Locher

(57) ABSTRACT

The fitting of hearing aids and other hearing devices is intended to be made more comfortable. For this, provision is made for a hearing device with a housing which contains a signal processing unit and has a sound outlet. A supporting hook for attaching the hearing device to an ear or a head can be fixed on the sound outlet of the housing such that sound emanating from the sound outlet is guided through the supporting hook. A sensor for detecting the type of supporting hook is arranged in or on the housing. The sensor controls the signal processing unit as a function of the detected type of supporting hook. Thus, the user can for example use different types of supporting hooks without having to decide on a type of supporting hook during the first fitting. Moreover, the degree of mass production of the hearing aid can be further increased by the automatic recognition of the type of supporting hook.

7 Claims, 2 Drawing Sheets

HEARING DEVICE WITH SUPPORTING HOOK RECOGNITION

CROSS-REFERENCE TO RELATED APPLICATION

This application claims the priority, under 35 U.S.C. §119, of German application DE 10 2009 008 045.7, filed Feb. 9, 2009; the prior application is herewith incorporated by reference in its entirety.

BACKGROUND OF THE INVENTION

Field of the Invention

The present invention relates to a hearing device with a housing which contains a signal processing unit and has a sound outlet. A supporting hook for attaching the hearing device to an ear or a head can be fixed on the sound outlet of the housing such that sound emanating from the sound outlet is guided through the supporting hook. The term "hearing device" in this case is understood to mean any portable sound-emitting equipment in/on the ear or on the head, in particular a hearing aid, a headset, earphones or the like.

Hearing aids are portable hearing devices used to support the hard of hearing. In order to make concessions for the numerous individual requirements, different types of hearing aids are provided, e.g. behind-the-ear (BTE) hearing aids, hearing aids with an external earpiece (receiver in the canal [RIC]) and in-the-ear (ITE) hearing aids, for example concha hearing aids or canal hearing aids (ITE, CIC) as well. The hearing aids listed in an exemplary fashion are worn on the concha or in the auditory canal. Furthermore, bone conduction hearing aids, implantable or vibrotactile hearing aids are also commercially available. In this case the damaged sense of hearing is stimulated either mechanically or electrically.

In principle, the main components of hearing aids are an input transducer, an amplifier and an output transducer. In general, the input transducer is a sound receiver, e.g. a microphone, and/or an electromagnetic receiver, e.g. an induction coil. The output transducer is usually configured as an electroacoustic transducer, e.g. a miniaturized loudspeaker, or as an electromechanical transducer, e.g. a bone conduction earpiece. The amplifier is usually integrated into a signal processing unit. This basic configuration is illustrated in FIG. 1 using the example of a behind-the-ear hearing aid. One or more microphones 2 for recording the sound from the surroundings are installed in a hearing aid housing 1 to be worn behind the ear. A signal processing unit 3, likewise integrated into the hearing aid housing 1, processes the microphone signals and amplifies them. The output signal of the signal processing unit 3 is transmitted to a loudspeaker or earpiece 4 which emits an acoustic signal. If necessary, the sound is transmitted to the eardrum of the equipment wearer using a sound tube which is fixed in the auditory canal with an ear mold. A battery 5 likewise integrated into the hearing aid housing 1 supplies the hearing aid and in particular the signal processing unit 3 with energy.

In BTE hearing aids, a supporting hook is usually fixed to the hearing aid housing and is used to hang the hearing aid on a pinna. The supporting hook guides sound produced in the hearing aid housing through to a sound tube which passes the amplified sound to the auditory canal.

In one type of hearing aid, the sound tube is plugged onto the supporting hook at the free end of the supporting hook. Therefore, the sound tube has a correspondingly large diameter. In another type of hearing aid, a very thin sound tube which is unlikely to be fitted onto a supporting hook is used and it is therefore fixedly installed in a small supporting hook. Such small supporting hooks and thin sound tubes are optically less conspicuous and are therefore preferred by a large number of users.

The transmission of the sound from the hearing aid housing or loudspeaker to the auditory canal basically depends on the utilized sound tube and supporting hook. Therefore, the sound amplification should be set as a function of the utilized sound tube or supporting hook during the fitting of the hearing aid. It follows that the hearing aid wearer has to specify definitively to the audiologist the type of supporting hook or sound tube that he will use before use is made of the hearing aid. Subsequent changing of the supporting hook or the sound tube requires a completely new fitting.

U.S. Pat. No. 7,245,728 B2 discloses for hearing aids a microphone arrangement which can be switched into a directional and an omnidirectional mode. For this, the microphone arrangement has a front side sound inlet and a rear side sound inlet. Moreover, the microphone arrangement has a switch which can be moved between a first position for the omnidirectional operation, in which the sound inlet on the rear side is closed off, and a second position for the directional operation, in which the sound inlet on the rear side is not closed off. A circuit detects the position of the switch and selects a microphone output signal on the basis of the detected position.

SUMMARY OF THE INVENTION

It is accordingly an object of the invention to provide a hearing device with supporting hook recognition which overcomes the above-mentioned disadvantages of the prior art devices of this general type, which simplifies the fitting of a hearing aid, particularly in respect of the selection of the type of supporting hook.

According to the invention, the object is achieved by a hearing device with a housing which contains a signal processing unit and has a sound outlet. A supporting hook for attaching the hearing device to an ear or a head can be fixed on the sound outlet of the housing such that sound emanating from the sound outlet is guided through the supporting hook. A sensor for detecting the type of supporting hook is arranged in or on the housing, and the sensor controls the signal processing unit as a function of the detected type of supporting hook.

Therefore, it is advantageously possible for the hearing device to automatically recognize the type of supporting hook or the type of supporting hook-sound tube combination and correspondingly configure the signal processing. Therefore, in the most expedient case it is sufficient for the hearing device equipped with a specific supporting hook to be individually fitted once because the device automatically adjusts acoustically to the new type of supporting hook or sound tube after the supporting hook has been replaced.

In a specific embodiment, the sensor can be a distance sensor for detecting a distance between a supporting hook and the housing. Therefore, if the type of supporting hook is coded by means of the distance between the housing and the supporting hook, the type of supporting hook can thus be determined by the distance sensor.

Alternatively, the sensor can be a pressure sensor for detecting a pressure which a supporting hook exerts on a surface of the pressure sensor. Using this, types of supporting hooks can for example be distinguished by the fact that they have pressure surfaces, the distances of which from the housing vary like in the mentioned distance sensor. By way of example, if the distance is smaller, then more pressure is generated by a spring than in the case of a greater distance.

Furthermore, the sensor can be a magnetic sensor which reacts to a magnetic or magnetizable element in a supporting hook. Such a magnetic sensor is generally found to be very robust and durable.

According to a further embodiment, amplification of the signal processing unit can be controlled by the sensor. Using this, the output signal of the hearing device can be precisely matched acoustically to the supporting hook or the sound tube attached thereto.

As was already indicated above, the hearing device can be configured as a BTE hearing aid. As a result of this, a hearing aid wearer can easily change his/her supporting hook, even after the fitting, and the hearing aid automatically recognizes the new type of supporting hook and appropriately adjusts the signal processing.

Thus, overall, provision can be made for a hearing system with an above-described hearing device and a first supporting hook of a first type and a second supporting hook of a second type. According to a specific embodiment, the first supporting hook interacts with the sensor while the second supporting hook does not. Accordingly, the sensor only has to decide in a binary fashion whether a first or a second type of supporting hook is attached to the hearing device.

The first supporting hook preferably is a supporting hook to which a sound tube can be fitted, while the second supporting hook is a supporting hook into which a sound tube is fixedly inserted, with the sound tube of the second supporting hook having a significantly smaller diameter than that of the first supporting hook. Using this, the hearing system can automatically distinguish between supporting hooks with sound tubes of different diameters.

Other features which are considered as characteristic for the invention are set forth in the appended claims.

Although the invention is illustrated and described herein as embodied in a hearing device with supporting hook recognition, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
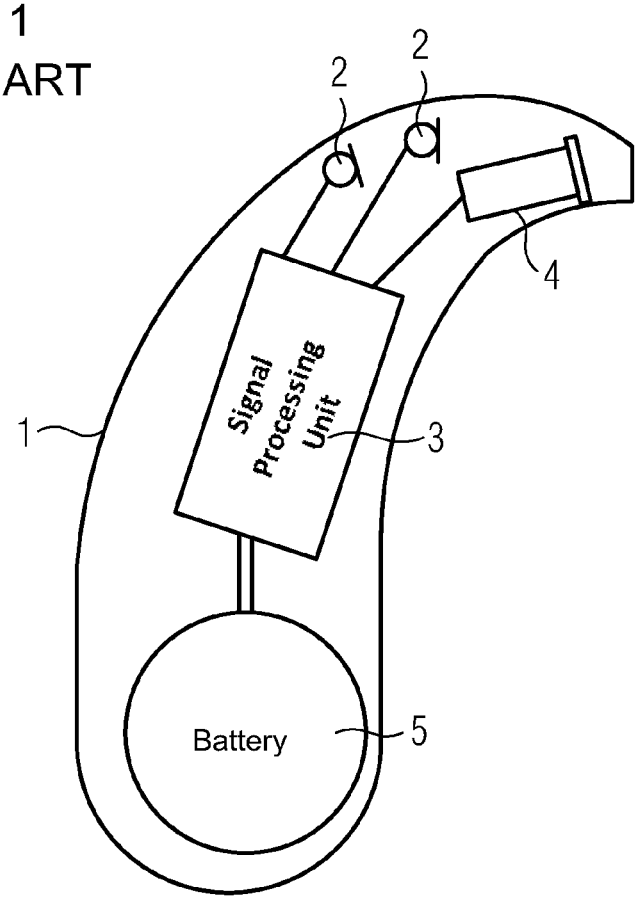
FIG. 1 PRIOR ART
FIG. 1 is an illustration of a basic configuration of a hearing aid according to the prior art.
Figure 2:
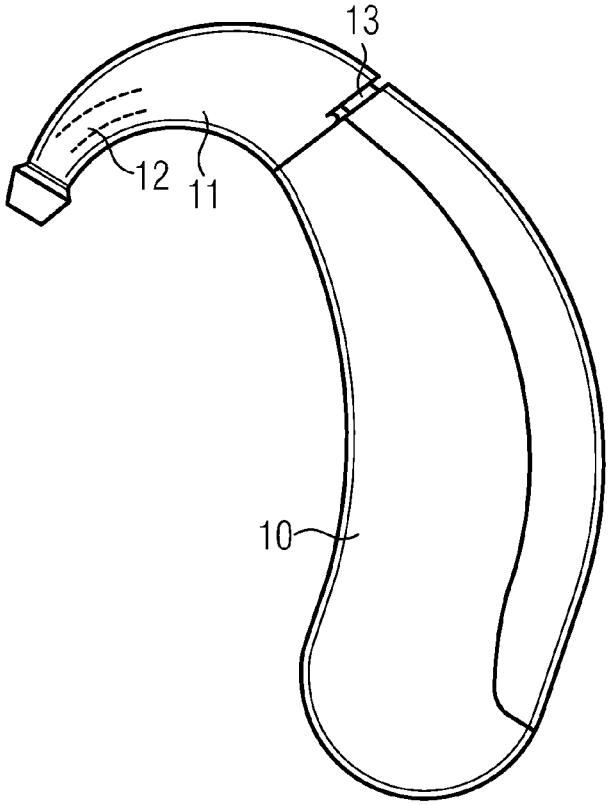
FIG. 2 is an illustration of a BTE hearing aid with a first type of supporting hook according to the invention.

Referring now to the figures of the drawing in detail and first, particularly, to FIG. 2 thereof, there is shown a BTE hearing aid that has a housing 10 with a supporting hook 11 fixed to the latter. A sound channel 12 is indicated in the supporting hook 11 and it guides the sound produced by the signal processing unit within the hearing aid housing 10 to the outside. At the free end of the supporting hook 11, a sound tube is intended to be fitted onto the conically formed end of the supporting hook. The sound tube must have a correspondingly large internal diameter in order for the pointed end of the supporting hook to be able to be inserted into the sound tube.

The supporting hook 11 is typically fixed to a connection piece (not visible in FIG. 2) which guides the sound out of the hearing aid housing 10 and thus acts as a sound outlet of the housing. There is a sensor 13 at the end face of the housing 10 to which the supporting hook 11 is also affixed. In the present case, this is a pressure sensor with a pushbutton. An outer face of the supporting hook 11, which is directed toward the end face of the housing 10 in the state where the supporting hook 11 is placed on the housing 10, presses against this pushbutton or piston of the pressure sensor 13. The pressure sensor 13 registers the piston being pushed in. This sensor information is interpreted for the signal processing of the hearing aid to the effect that a conventional supporting hook 11 with a sound tube which can be fitted thereon is attached to the hearing aid housing 10. As a result of this, the signal processing unit switches into a first processing profile in which the acoustics of the particular supporting hook and sound tube are taken into account. In particular, the amplification is fitted, possibly channel-specifically, to the hearing aid output (supporting hook with sound tube).

Figure 3:
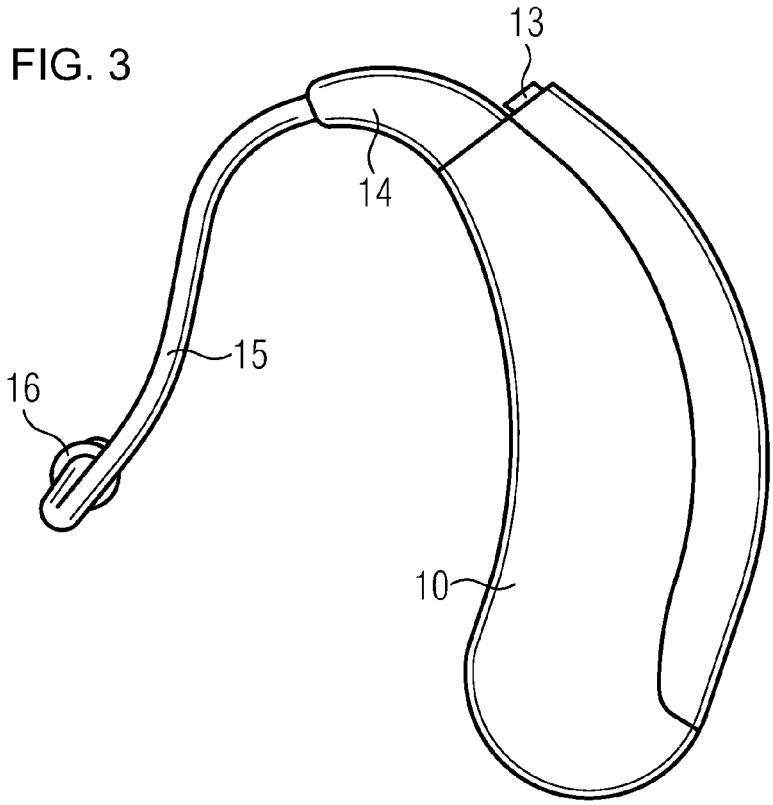
FIG. 3 is an illustration of a BTE hearing aid with a second type of supporting hook.

In FIG. 3, a supporting hook 14 which is very small compared to the supporting hook 11 and has a thin sound tube 15 is fitted onto the hearing aid housing 10. At the free end of the sound tube 15 there is an adaptor 16 for plugging on an earpiece which should fix the sound tube in the auditory canal. The earpiece itself is not illustrated in FIG. 3.

The sound tube 15 has a relatively small external diameter (smaller than the tip of the supporting hook 11 in FIG. 2) and is in this case fixedly inserted, adhesively bonded or molded into the small supporting hook 14. Due to its small internal diameter, it cannot be fitted onto the large supporting hook 11. Since it is not very optically conspicuous, this small supporting hook-tube combination 14, 15 is preferred by many hearing aid users.

It is clear from FIG. 3 that the small supporting hook 14 does not touch the pressure sensor and in particular the pushbutton or piston thereof. Thus, no pressure is exerted onto the pressure sensor 13 and so a corresponding sensor signal is used by the signal processing unit to perform amplification (second processing profile) matched to the supporting hook-tube combination 14, 15 in the hearing aid. Therefore, the hearing aid signal processing can automatically distinguish by means of the sensor signal which sound output signal should be generated to achieve an optimum acoustic fit.

In the example of FIG. 2 and FIG. 3, there is only a more detailed differentiation between two types of supporting hooks. In the process, the fact that the supporting hook in one case interacts with the sensor but not in the other is used.

If more than two different types of supporting hook (synonymous in the present document with types of supporting hook-sound tube combinations) are intended to be recognized automatically by the hearing aid signal processing, the different types of supporting hooks have to be coded correspondingly. In the example of a pressure sensor, the distance between the pressure surface of the supporting hook and the end face of the hearing aid housing can for example be used for the coding. In the specific example which is analogous to FIGS. 2 and 3, a third type of supporting hook could be characterized in that the pressure surface of the supporting hook comes into direct contact with the end side of the hearing aid housing 10 when the supporting hook is fitted to the hearing aid housing. The piston or pushbutton of the pressure sensor 13 would then be completely pushed in. The pressure sensor would then have to be able to distinguish between the completely pushed-in state, the half-pushed-in state and the not-pushed-in state.

The sensor for recognizing the supporting hook or the supporting hook-tube combination can also be based on other physical principles than pressure. By way of example, it is also possible that use is made of a magnetic, an electric, an optical or a different type of sensor. The coding of the type of supporting hook can then be effected appropriately. These sensors can also be designed to distinguish between more than two types of supporting hooks.

Thus, the advantage for the hearing aid manufacturer is that he is able to adjust a hearing aid in advance without knowing what type of supporting hook the hearing aid wearer will use. Moreover, this also results in advantages for mass production concepts because the hearing aid wearer can also belatedly choose between, for example, a conventional supporting hook and a supporting hook with a reduced size and the hearing aid then automatically changes the signal processing depending on the attached supporting hook. In the process, it is not only the amplification which can be changed automatically, but also, for example, feedback reduction algorithms and other functions.

The invention claimed is:

1. A hearing device, comprising:

a signal processing unit;

a housing containing said signal processing unit and having a sound outlet;

a supporting hook for attaching the hearing device to one of an ear and a head and fixed on said sound outlet of said housing such that sound emanating from said sound outlet is guided through said supporting hook; and a sensor for detecting a type of said supporting hook disposed one of in said housing and on said housing, said sensor controlling said signal processing unit in dependence on a detected type of said supporting hook, said sensor being a pressure sensor for detecting a pressure which said supporting hook exerts on a surface of said pressure sensor, said pressure sensor having a pushbutton and depending on different pushed-in states of said pushbutton, said pressure sensor determining the type of said supporting hook.

2. The hearing device according to claim 1, wherein amplification of said signal processing unit can be controlled by said sensor.

3. The hearing device according to claim 1, wherein the hearing device is a behind-the-ear hearing aid.

4. A hearing system, comprising:

a hearing device having a housing, a signal processing unit, and a sound outlet;

supporting hooks for attaching said hearing device to one of an ear and a head and fixed on said sound outlet of said housing such that sound emanating from said sound outlet is guided through said supporting hooks, said supporting hooks including a first supporting hook of a first type and a second supporting hook of a second type; and a sensor for detecting a type of said supporting hooks disposed one of in said housing and on said housing, said sensor controlling said signal processing unit in dependence on a detected type of said supporting hooks, said sensor being a pressure sensor for detecting a pressure which said supporting hooks exert on a surface of said pressure sensor, said pressure sensor having a pushbutton and depending on different pushed-in states of said pushbutton, said pressure sensor determining the type of said supporting hooks.

5. The hearing system according to claim 4, wherein said first supporting hook interacts with said sensor and said second supporting hook does not interact with the sensor.

6. The hearing system according to claim 4, wherein a sound tube can be fitted to said first supporting hook.

7. The hearing system according to claim 4, further comprising a sound tube fixedly inserted into said second supporting hook.

* * * * *